US005331818A

United States Patent [19]

Rathbone

[11] Patent Number: 5,331,818

[45] Date of Patent: Jul. 26, 1994

[54] AIR SEPARATION

[75] Inventor: Thomas Rathbone, Farnham, England

[73] Assignee: The BOC Group plc, Windlesham, England

[21] Appl. No.: 81,359

[22] Filed: Jun. 23, 1993

[51] Int. Cl.[5] ..... F25J 3/02

[52] U.S. Cl. ..... 62/24; 62/38; 62/39

[58] Field of Search ..... 62/24, 38, 39

[56] References Cited

U.S. PATENT DOCUMENTS

| | | | |
|---|---|---|---|
| 4,936,099 | 6/1990 | Woodward et al. | 62/24 |
| 5,069,699 | 12/1991 | Agrawal | 62/64 |
| 5,231,837 | 8/1993 | Ha | 62/24 |
| 5,257,504 | 11/1993 | Agrawal et al. | 62/24 |

FOREIGN PATENT DOCUMENTS

| | | |
|---|---|---|
| 0136926 | 4/1985 | European Pat. Off. . |
| 0384688 | 8/1990 | European Pat. Off. . |
| 0538118 | 4/1993 | European Pat. Off. . |
| 3528374 | 2/1987 | Fed. Rep. of Germany . |

*Primary Examiner*—Ronald C. Capossella
*Attorney, Agent, or Firm*—David M. Rosenblum; Larry R. Cassett

[57] ABSTRACT

Air is rectified in a rectification system comprising a higher pressure rectification column, an intermediate pressure rectification column, and a lower pressure rectification column. A first reboiler-condenser provides liquid nitrogen reflux for the higher pressure rectification column and for the lower pressure rectification column and also reboils the intermediate pressure rectification column. Another reboiler-condenser provides liquid nitrogen reflux for the intermediate pressure rectification column and reboils the lower pressure rectification column. Air is fed to the higher pressure rectification column through a pair of inlets. A first oxygen product is withdrawn from the intermediate pressure rectification column by a pump. Gaseous nitrogen products are withdrawn from the intermediate and lower pressure rectification columns through a pair of outlets thereof.

23 Claims, 2 Drawing Sheets

AIR SEPARATION

BACKGROUND

This invention relates to a method and apparatus for separating air.

The most important method commercially for separating air is by rectification. Typically, a so-called "double rectification column" comprising a higher pressure and a lower pressure rectification column is used. Downstream of its being purified to remove components of low volatility such as water vapour and carbon dioxide, and being cooled to a temperature suitable for separation by rectification, most if not all of the air to be separated is introduced into the higher pressure column and is separated into oxygen-enriched liquid air and nitrogen vapour. The nitrogen vapour is condensed. A part of the condensate is used as liquid reflux in the higher pressure column. Oxygen-enriched liquid is withdrawn from the bottom of the higher pressure column is sub-cooled, and is introduced into an intermediate region of the lower pressure rectification column through a throttling valve. This oxygen-enriched liquid is separated into oxygen and nitrogen products in the lower pressure rectification column. Liquid nitrogen reflux for the lower pressure rectification column is provided by taking the remainder of the condensate from the higher pressure column, sub-cooling it, and passing it into the top of the lower pressure rectification column through a throttling valve.

It has been proposed that in a Heylandt cycle a 'triple column' arrangement can be used with a third column operating at a higher pressure than the conventional higher pressure column of a double column arrangement. The third column has a condenser that provides reboil for the higher pressure column and the incoming air is admitted to the third column. The purpose of this arrangement is to remedy a shortage of liquid nitrogen reflux in the rectification columns of a Heylandt cycle when the oxygen product is withdrawn entirely as liquid from the lower pressure column, no products being withdrawn from the higher pressure column.

Conventionally, in a double column arrangement the lower pressure rectification column is operated at pressures in the range of 1 to 1.5 bar absolute so as to produce oxygen and nitrogen products at about atmospheric pressures. There is however today an increasing demand for producing oxygen at high rates at pressures well in excess of 2 bar for use in such processes as coal gasification. It is known from for example U.S. Pat. No. 4,224,045 that a relatively low purity oxygen product can be produced in the lower pressure rectification column when that column is operated at pressures well in excess of 2 bar. The need to compress the oxygen product is therefore reduced or obviated. A nitrogen product is also produced from the lower pressure rectification column. In order to recover work from the waste nitrogen stream, it is compressed and then expanded in the expander of a gas turbine. The nitrogen may be supplied to the combustion chamber of the gas turbine where it serves to reduce the formation of oxides of nitrogen.

In some instances, the expander has insufficient capacity to accept all the nitrogen product of the air separation plant. In such instances, an additional expansion turbine, independent of the gas turbine, may be used to recover work from the residual nitrogen product.

It is an aim of the present invention to provide a method and apparatus which makes it possible to produce gaseous oxygen and gaseous nitrogen products at pressure without the rate of production of such gaseous nitrogen being determined by the rate of production of such oxygen product.

SUMMARY OF THE INVENTION

According to the present invention there is provided a method of separating air, comprising rectifying air in a rectification system comprising a higher pressure rectification column, a lower pressure rectification column and an intermediate pressure rectification column, providing each column with liquid nitrogen reflux, employing vapour from the higher pressure rectification column to reboil liquid obtained in the intermediate pressure rectification column, and vapour from the intermediate pressure rectification column to reboil liquid obtained in the lower pressure rectification column, introducing a stream of feed air into the higher pressure rectification column, withdrawing a first oxygen product and a first gaseous nitrogen product from the intermediate pressure rectification column and also withdrawing a second nitrogen product or stream from the lower pressure rectification column.

The invention also provides apparatus for separating air comprising, a higher pressure rectification column, a lower pressure rectification column and an intermediate pressure rectification column, means for providing each rectification column with liquid nitrogen reflux, a first reboiler for reboiling, by heat exchange with vapour from the higher pressure rectification column, liquid obtained in the intermediate pressure rectification column, a second reboiler for reboiling, by heat exchange with vapour from the intermediate pressure rectification column, liquid obtained in the lower pressure rectification column, an inlet to the higher pressure rectification column for a feed air stream, an outlet from the intermediate pressure rectification column for the withdrawal of a first oxygen product, an outlet from the intermediate pressure rectification column for the withdrawal of a first gaseous nitrogen product, and an outlet from the lower pressure rectification column for the withdrawal of a second nitrogen product or stream.

By the term 'product' as applied herein to a fluid is meant that the fluid is withdrawn from one of the rectification columns and at least part of the fluid is not returned to any of the rectification columns. The term 'product' thus encompasses a stream that is withdrawn from one of the rectification column and is eventually vented to the atmosphere.

Typically, the rate at which the first gaseous nitrogen product is withdrawn from the intermediate pressure column may be selected to meet at least part of a given demand for pressurised nitrogen, and at least some of the 'excess' nitrogen is produced as the second nitrogen product from the lower pressure rectification column. Accordingly, in the above-mentioned example of supplying nitrogen at pressure to the expander of a gas turbine, the rate of production of the first nitrogen product, together with any nitrogen taken as product from the higher pressure rectification column, may be selected so as to meet exactly the maximum capacity that the expander has for such nitrogen, thereby obviating the need for any separate expansion turbine to recover work from excess nitrogen at pressure.

The first nitrogen product is preferably withdrawn from an intermediate separation stage of the intermediate pressure rectification column. By an intermediate separation stage is meant, in the example of an intermediate rectification column having trays to effect mass exchange between liquid and vapour phases, a tray that is below the top tray but above the bottom tray, and in the example of an intermediate rectification column having packing to effect mass exchange between liquid and vapour phases, a level of the column above and below which packing is provided. The intermediate stage is preferably selected such that the first nitrogen product contains from 95 to 99% by volume of nitrogen and is therefore of less than normal merchant purity. If desired, a third nitrogen product, typically containing less than 0.1% by volume of impurities, may be withdrawn from a separation stage of the intermediate rectification column above that form which the first nitrogen product is taken. The third nitrogen product is preferably taken from the topmost separation stage of the intermediate rectification column. It is preferably taken as liquid so as to facilitate its storage.

The first oxygen product preferably contains from 80 to 95% by volume if it is to be used in a gasification process. In the method and apparatus according to the invention, a second oxygen product, typically of normal merchant quality, that is containing less than 0.5% by volume of impurities, may be withdrawn from, typically, the bottom of the lower pressure rectification column, preferably in liquid state. If no second oxygen product is taken from the lower pressure rectification column, liquid oxygen is preferably withdrawn therefrom and introduced into another of the rectification columns.

Preferably, the higher pressure rectification column is operated at a pressure (at its top) within the range of 12 to 20 bar; the intermediate pressure column at a pressure (at its top) in the range of 4 to 8 bar; and the lower pressure column at a pressure (at its top) of 1.2 to 2 bar.

The air to be rectified is preferably cooled by countercurrent heat exchange with the first oxygen and first nitrogen products in a main heat exchanger to a cryogenic temperature suitable for its rectification. Purification of the air is preferably effected upstream of the rectification columns, typically by adsorbing carbon dioxide and water vapour therefrom upstream of the main heat exchanger.

It is preferred that the first oxygen product be withdrawn by a pump in its liquid state from preferably the intermediate pressure rectification column. In examples of the invention in which the first oxygen product is taken as a liquid, a second air stream is preferably compressed to a higher pressure than the feed air stream and passed through the main heat exchanger co-currently therewith. The second air stream helps to enable the main heat exchanger to operate efficiently. It is preferably also used as a source of air for expansion with the performance of external work so as to meet the refrigeration requirements of the method. Preferably, a first portion of the second air stream is taken from the main heat exchanger at a temperature in the range of 270 to 190 K. for expansion in a first expansion turbine, the resulting air being returned to the main air stream, and a second portion of second air stream is taken at a temperature in the range of 140 to 190 K. and is expanded in a second expansion turbine, the resulting expanded air being introduced into the higher pressure rectification column. That part of the second air stream which is not taken for expansion in the first or second expansion turbine is preferably passed through a throttling valve to form a mixture of liquid and vaporous air, which mixture is preferably introduced into the higher pressure rectification column.

Preferably, the first reboiler condenses said vapour from the higher pressure rectification column to form liquid nitrogen, and one part of the liquid nitrogen is used as reflux in the higher pressure rectification column; another part is used as reflux in the lower pressure rectification column; and a third part is used as reflux in that the intermediate pressure rectification column, preferably being introduced into this column at the same separation stage as that from which the first nitrogen product is withdrawn. Reflux for that region of the intermediate pressure rectification column above the stage from which the first nitrogen product is withdrawn is preferably provided by nitrogen condensed in the second reboiler.

The liquid nitrogen flow to the stage of the intermediate pressure rectification column from which the first nitrogen product is taken is preferably supplemented by taking a part of the first nitrogen product typically from downstream of the main heat exchanger, recompressing it, condensing it, and returning it to said stage of said intermediate pressure rectification column. The condensed, recompressed nitrogen is preferably sub-cooled upstream of its being returned to said stage of the intermediate pressure rectification column from which the first nitrogen product is taken. Condensation of the recompressed nitrogen is preferably effected by heat exchange in a condenser-reboiler with a boiling stream of oxygen-enriched liquid air taken from the bottom of the higher pressure rectification column. The resulting boiled air is preferably introduced into the intermediate pressure rectification column. It is also possible though not preferred, to recompress and condense some or all of the second nitrogen product or stream.

Preferably, a stream of oxygen-enriched liquid air is withdrawn from the bottom of the higher pressure rectification column, is sub-cooled, and is passed through a throttling valve into the intermediate pressure rectification column. If desired, the intermediate pressure rectification column may also be fed with liquid air unenriched in oxygen.

A number of different sources of mixtures of oxygen and nitrogen may be used to feed the lower pressure rectification column. These include the oxygen-enriched liquid air from the higher pressure rectification column, a stream of corresponding composition from the intermediate pressure rectification column, a stream of liquid air taken from the higher pressure rectification column, or indeed, a stream withdrawn from the impure oxygen product. The choice is made in accordance with the ratio of second oxygen product to third nitrogen product that it is desired to produce. In general, the more second oxygen product that it is desired to produce, the richer in oxygen is the feed to the lower pressure rectification column.

If desired, a further rectification column may be employed to produce a crude argon product from an argon-enriched oxygen stream taken from the lower pressure rectification column.

BRIEF DESCRIPTION OF THE DRAWINGS

The method and apparatus according to the present invention will now be desired by way of example with reference to the accompanying drawings; in which.

The drawings are not to scale.

DETAILED DESCRIPTION

Figure 1:
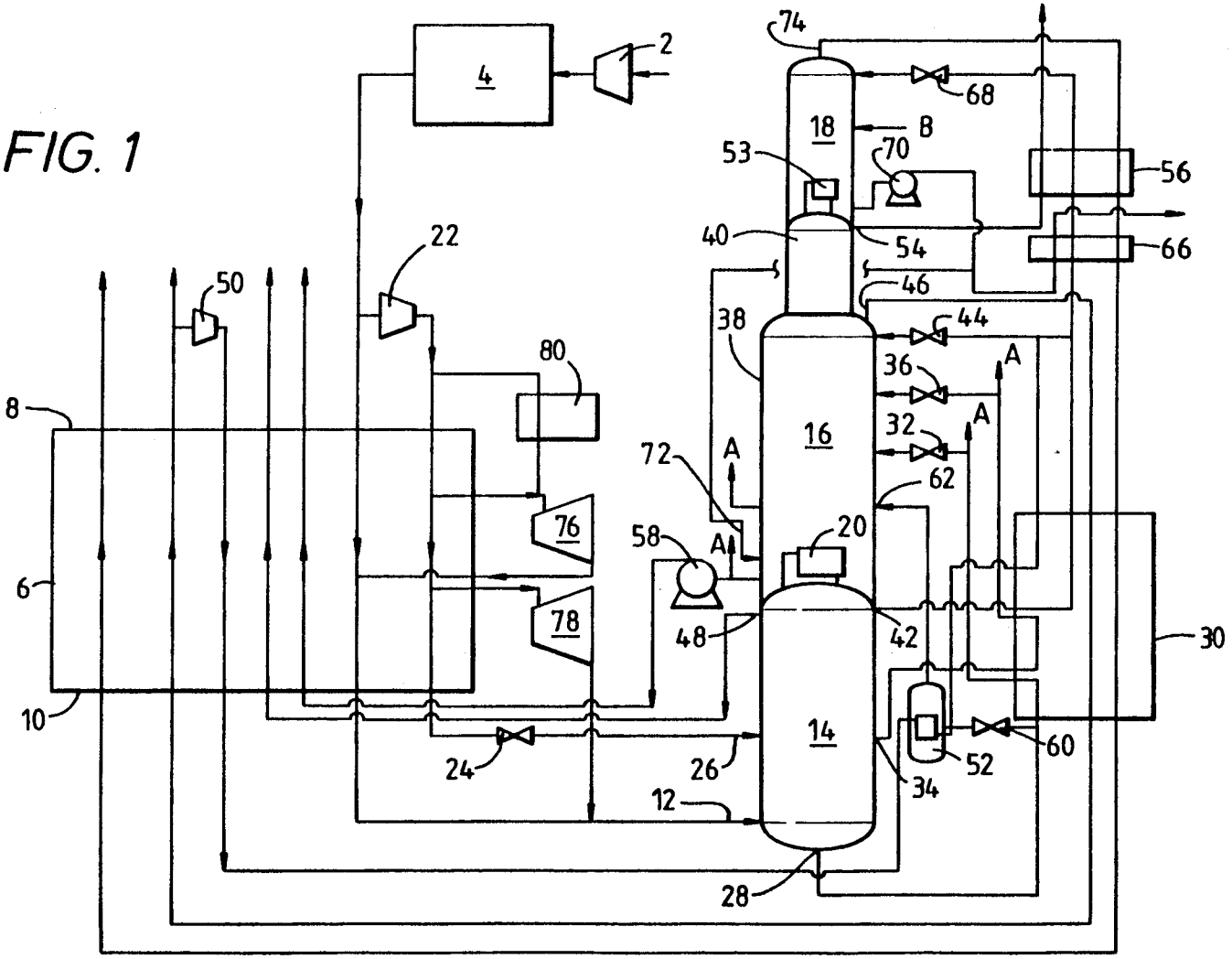
FIG. 1 is a schematic flow diagram of an air separation plant.

Referring to FIG. 1 of the drawings, air is compressed in a compressor 2 provided with an aftercooler (not shown) to a chosen pressure in the range of 10 to 20 bar. The resulting compressed air stream flow through a purification unit 4 effective to remove water vapour and carbon dioxide therefrom. The unit 4 employs beds of adsorbent (not shown) to effect this removal of water vapour and carbon dioxide. The beds are operated out of sequence with one another such that one or one or more beds are being used to purify air the remainder are being regenerated for example by means of a stream of hot nitrogen. Such purification units and their operation are well known in the art and need not be described further herein. The purified air stream is then divided into first and second feed air streams. The first feed air stream, typically comprising about 40% of the total flow of purified air, flows through a main heat exchanger 6, typically of the plate-fin kind, from a warm end 8 to a cold end 10. It leaves the cold end at a temperature close to saturation at the prevailing pressure and flows through an inlet 12 into a higher pressure rectification column 14. The higher pressure rectification column 14 is associated with an intermediate pressure rectification column 16 and a lower pressure rectification column 18. Each of the rectification columns 14, 16 and 18 are provided with liquid-vapour contact devices whereby a descending liquid phase is brought into intimate contact with an ascending vapour phase such that mass transfer between the two phases takes place. The descending liquid phase becomes progressively richer in oxygen and the ascending vapour phase progressively richer in nitrogen. The liquid-vapour contact means may typically comprise sieve trays. Each tray may be viewed as a separate separation stage.

Reflux for the higher pressure rectification column 14 is provided by a first reboiler-condenser 20. Impure nitrogen (typically containing in the order of 1% by volume of impurity) passes from the top of the higher pressure rectification column 14 into the first condenser-reboiler 20 and is condensed by heat exchange with impure liquid oxygen obtained at the bottom of the intermediate pressure rectification column 16. The impure liquid oxygen is itself reboiled by this heat exchange. A part of the resulting liquid nitrogen flows downwardly through the column 14 as reflux. The air introduced into the bottom of the higher pressure rectification column 14 through the inlet 12 ascends the column 14 and exchanges mass with the downwardly flowing liquid. A sufficient number of separation stages (for example trays (not shown)) is included in the rectification column 14 to enable nitrogen of a desired purity to be obtained at the top of this rectification column 14. The pressure at the top of the rectification column 14 may be in the order of 18 bar.

The first feed air stream is not the only air stream that is introduced into the higher pressure rectification column 14. The second feed air stream is compressed to a pressure of 75 bar in a compressor 22 provided with an aftercooler (not shown) and then flows through the main heat exchanger 6 from its warm end 8 to its cold end 10. The resulting fluid stream then passes through a throttling valve 24 and enters the higher pressure rectification column 14 through an inlet 26 predominantly (in mass flow terms) in liquid state. The air entering the higher pressure rectification column 14 through the inlets 12 and 26 is separated into nitrogen and oxygen-enriched liquid fractions. The oxygen-enriched liquid fraction collecting at the bottom of the column 14 is approximately in equilibrium with the air introduced through the inlet 12. A stream of this liquid-enriched liquid fraction is withdrawn from the bottom of the higher pressure rectification column 14 through an outlet 28, is sub-cooled by passage a part of the way through a heat exchanger 30 and is withdrawn therefrom at a temperature of approximately 116 K. The sub-cooled oxygen-enriched liquid air stream is then passed through a throttling valve 32 and flows into the intermediate pressure rectification column 16 at a chosen level thereof. A stream of liquid air, substantially unenriched in oxygen, is withdrawn through an outlet 34 from the same separation stage of the higher pressure rectification column 14 as that to which liquid air is fed from the inlet 26. The stream of liquid air withdrawn through the outlet 34 is introduced into the heat exchanger 30 at the same region thereof as that from which the sub-cooled oxygen-rich liquid air taken from the bottom of the higher pressure rectification column 14 is withdrawn. The liquid air stream is sub-cooled in the heat exchanger 30, and is withdrawn therefrom at an intermediate location thereof at a temperature of 111 K. The resulting sub-cooled liquid air stream passes through a throttling valve 36 and flows into the intermediate pressure rectification column 16 at a stage thereof located above the one that receives oxygen-enriched liquid from the throttling valve 32.

The fluid introduced into the intermediate pressure rectification column 16 via the throttling valves 32 and 36 is separated therein into an oxygen fraction and a nitrogen fraction. As shown in FIG. 1 of the drawings, the intermediate pressure rectification column 16 comprises a lower section 38 which is of greater diameter than an upper section 40 which is shown contiguous therewith but, if desired, may be separate therefrom. A second part of the liquid nitrogen condensate formed in the condenser-reboiler 20 is withdrawn from the higher pressure rectification column 14 through an outlet 42, is introduced into the heat exchanger 30 at the same region as that from which the sub-cooled liquid air stream withdrawn from the column 14 through the outlet 34 leaves the heat exchanger 30. The liquid nitrogen stream, withdrawn through the outlet 42 then flows through the heat exchanger 30 to its cold end and is thereby sub-cooled. The resulting sub-cooled stream of liquid nitrogen leaves the heat exchanger 30 at a temperature of 101 K. One part of it is passed through a throttling valve 44 and flows into the top of the lower section 38 of the intermediate pressure rectification column 16. The liquid nitrogen introduced into the top of the lower section 38 of the intermediate pressure rectification column 16 provides liquid reflux for enable the separation of the streams introduced into the column 16 from the higher pressure rectification column 14. The reboiler 20 reboils the liquid oxygen fraction obtained at the bottom of the intermediate pressure rectification column 16 to provide an adequate upflow of vapour through the column. An impure first nitrogen product is withdrawn in gaseous state through an outlet 46 at the top of the lower section 38 of the intermediate pressure rectification column 16. Most of the nitrogen vapour at this stage is in fact withdrawn through the outlet 46. A stream of impure nitrogen thus flows from the outlet 46 and passes through the heat exchanger 30 from its cold end to its warm end. The first nitrogen product stream then flows through the heat exchanger 6 from its cold end 10 to its warm end 8 and leaves the heat exchanger 6 at approximately ambient temperature. This impure nitrogen product stream typically contains 1% of impurities and is produced at a pressure of 6.5 bar. The nitrogen product stream is then passed to an expansion turbine (not shown) in order to recover power from it. Typically, the nitrogen requires further compression upstream of the expansion turbine.

A further impure nitrogen product stream is withdrawn from the plant shown in FIG. 1 of the drawings. This further impure nitrogen stream is taken from the top of the higher pressure rectification column 14 through an outlet 48 and flows through the heat exchanger 6 from its cold end 10 to its warm end 8. It leaves the heat exchanger 6 at approximately ambient temperature and at a pressure of approximately 18 bar. It may also be passed to the expansion turbine (not shown) for recovery of power. Taking this high-pressure nitrogen stream offers the advantage that the amount of extra compression required upstream of the expansion turbine (not shown) is reduced. Typically, the plant shown in FIG. 1 is operated such that the amount of gaseous nitrogen product produced from the higher pressure rectification column 14 and the intermediate pressure rectification column 16 is arranged to match the requirements for such nitrogen of the gas turbine (not shown) thereby making it possible to optimise the operation of the gas turbine without producing excess impure gaseous nitrogen product at pressure.

That part of the sub-cooled liquid nitrogen stream which does not flow through the expansion valve 44 is used to provide reflux for the lower pressure rectification column 18. In order to enable the reflux requirements of the lower section 38 of the intermediate pressure rectification column 16 to be met in addition to those of the higher pressure rectification column 14 and the lower pressure rectification column 18, notwithstanding the withdrawal of an impure nitrogen product stream withdrawn from the higher pressure rectification column 14 through the outlet 48, it is desirable to supplement the sub-cooled liquid nitrogen fed to the throttling valve 44. This is achieved by taking a minor portion of the first impure nitrogen product stream from downstream of its passage through the main heat exchanger 6 and compressing it to a pressure of about 12 bar in a nitrogen compressor 50. The nitrogen compressor 50 has an aftercooler (not shown) associated with it so as to remove the heat of compression from the nitrogen. The compressed nitrogen stream after passage through the aftercooler flows through the main heat exchanger 6 from its warm end 8 to its cold end 10. It then flows into a second condenser-reboiler 52 in which it is condensed. Resulting liquid nitrogen flows from the condenser-reboiler 52 at a temperature of 107 K. and enters the heat exchanger 30 at an intermediate region thereof. The nitrogen flows to the cold end of the heat exchanger 30, thereby being sub-cooled. The resulting sub-cooled liquid nitrogen is then passed through the throttling valve 44 in admixture with sub-cooled liquid nitrogen withdrawn from the column 14 through the outlet 42. The condensation of the compressed nitrogen stream in the condenser-reboiler 52 is effected by indirect heat exchange with a flow of liquid which is taken from the stream of oxygen-enriched liquid air intermediate the outlet 28 from the higher pressure rectification column 14 and the warm end of the heat exchanger 30. This flow of oxygen-enriched liquid air is passed through a throttling valve 60 upstream of its entry into the condenser-reboiler 52. Its pressure is thereby reduced to 7.3 bar. The oxygen-enriched liquid air is boiled in the condenser-reboiler 52 and the resulting vapour passes into the lower section 38 of the intermediate pressure rectification column 16 through an inlet 62.

Remaining nitrogen vapour not withdrawn from the top of the section 38 of the column 16 through the outlet 46 enters the upper section 40 of the column 16 which is used as a nitrogen purification section. Typically about twenty (theoretical) separation stages (provided by, for example, liquid-vapour contact trays) are used in the section 40 to give a nitrogen product containing less than 1 vpm of impurity. Nitrogen vapour obtaining at the top of the upper section 40 of the intermediate pressure rectification column 16, where the pressure is typically 7 bar, flows into a third condenser-reboiler 53 and is condensed therein by heat exchange with boiling liquid oxygen obtained at the bottom of the lower pressure rectification column 18. A part of the resulting condensed liquid nitrogen serves as reflux for the upper section 40 of the intermediate rectification column 16. The remainder is withdrawn from the top of the upper section 40 of the intermediate pressure rectification column 16 through an outlet 54, is sub-cooled in a heat exchanger 56 and is then sent to storage as a liquid nitrogen product (that is, the third nitrogen product previously referred to herein).

As well as producing relatively pure and impure nitrogen products, the intermediate pressure rectification column 16 also produces an impure (first) oxygen product. Thus, impure liquid oxygen typically containing 10% by volume of impurities is withdrawn from the bottom of the higher pressure rectification column 16 by a pump 58 which raises to 43 bar the pressure to which the liquid oxygen is subjected and passes the liquid oxygen through the main heat exchanger 6 from its cold end 10 to its warm end 8. The oxygen vaporises in its passage through the heat exchanger 6 and leaves the warm end 8 thereof at approximately ambient temperature. The oxygen may for example be used in the gasification of coal.

The lower pressure rectification column 18 is used to separate a relatively pure oxygen product from a stream of fluid comprising oxygen and nitrogen. This stream comprising oxygen and nitrogen may be taken from any one of a number of different sources which shall be described below. The first of these sources is the sub-cooled stream of liquid air, unenriched in oxygen, at a region upstream of the throttling valve 36; the second source is the sub-cooled stream of oxygen-enriched liquid air at a region upstream of the throttling valve 32; the third source is a stream of oxygen-enriched liquid which may be taken from an intermediate stage of the lower section 38 of the intermediate pressure rectification column 16 through an outlet 64; the fourth source is the impure oxygen product itself at a region upstream of the pump 58. In general, the choice of the source of oxygen-nitrogen mixture for separation in the lower pressure rectification column 18 will be determined by the mole ratio of relatively pure oxygen product to relatively pure nitrogen product that it is desired to produce. The higher this mole ratio, the lower the proportion of oxygen that it is desired to have in the fluid taken for separation in the lower pressure rectification column 18. Each of the possible sources of fluid for separation in the rectification column 18 is indicated by the reference A in the drawing. Whichever source is chosen may be sub-cooled by passage through a heat exchanger 66 (although such sub-cooling is not shown in the drawing) and is then introduced into the inlet indicated by the reference B in the drawing via a throttling valve (not shown).

Liquid nitrogen reflux for the lower pressure rectification column 18 is formed by taking from upstream of the throttling valve 44 a part of the sub-cooled liquid nitrogen withdrawn from the higher pressure rectification column 14 through the outlet 42. This part of the sub-cooled liquid nitrogen stream is further sub-cooled by passage through the heat exchangers 66 and 56. It then flows through a throttling valve 68 and is introduced into the top of the lower pressure rectification column 18. Reboil for the lower pressure rectification column 18 is provided by the condenser-reboiler 53. Relatively pure liquid oxygen is withdrawn from the bottom of the lower pressure rectification column 18 by a pump 70 and passes through the heat exchanger 66 from its warm end to its cold end so as to sub-cool it. Sub-cooled liquid oxygen product (the second oxygen product) is then sent to storage. Typically, this product contains less than 0.5% by volume of impurities (the predominant impurity being argon). If in order to maintain a mass balance in the lower pressure rectification column 18 it is required to withdraw more liquid oxygen by means of the pump 70 than there is a demand for, the excess liquid oxygen may if desired by introduced into the bottom of the intermediate pressure rectification column 16 through an inlet 72.

A vaporous product nitrogen stream (the second nitrogen product referred to hereinabove) is withdrawn through an outlet 74 at the top of the lower pressure rectification column 18 (where the pressure is 1.5 bar) and flows through the heat exchangers 56, 66 and 30 in sequence. It then flows through the main heat exchanger 6 from its cold end 10 to its warm end 8, thereby being warmed to approximately ambient temperature. This nitrogen stream withdrawn from the lower pressure rectification column 18 leaves the main heat exchanger 6 at a pressure a little above atmospheric pressure. It may be used in any process requiring such nitrogen, or it may be vented to the atmosphere, or it may be used to regenerate the adsorbent beds of the purification unit 4.

The refrigeration requirements of the plant shown in the drawing are met by withdrawing a part of the second feed air stream from an intermediate region of the main heat exchanger 6 at a temperature of 255 K. and expanding this withdrawn stream of air in a first expansion turbine 76. The resulting expanded air leaves the turbine 76 at a temperature of 180 K. and a pressure of about 18 bar. This stream is then merged with the main air stream as it flows through the heat exchanger 6. In addition, a second portion of the higher pressure air stream is withdrawn from the main heat exchanger 6 at a temperature of 18O K. and is expanded in a second expansion turbine 78. The resulting expanded air leaves the turbine 78 at a pressure of about 15 bar and a temperature of 122 K. The expanded air flow from the turbine 78 is mixed with the first feed air stream at a region intermediate the cold end 10 of the main heat exchanger 6 and the inlet 12 to the higher pressure rectification column 14.

In general, the plant shown in the drawing can operate satisfactorily without the need for "warm end refrigeration". If desired, however, such refrigeration may be provided from an external source, for example an absorption refrigeration machine using ammonia as a working fluid. Accordingly, a third portion of the higher pressure air stream may be taken from intermediate the compressor 22 and the warm end 8 of the main heat exchanger 6 and chilled to a temperature of 240 K. by operation of such a chiller 80. The resulting chilled air may be mixed with that taken for expansion upstream of the first expansion turbine 76.

If desired, the expansion turbine 76 and 78 may be used to provide part of the shaft power requirements of one or both of the compressors 22 and 50.

In a typical example of the operation of the plant shown in FIG. 1 of the drawings, 2040 standard tonnes per day of impure oxygen may be withdrawn as product from the medium pressure rectification column 16, and the total rate of production of relatively pure liquid oxygen and liquid nitrogen products may be up to 500 standard tonnes per day.

A number of modifications or additions to the plant shown in FIG. 1 of the drawings. For example, if some high purity gaseous oxygen is required, then part of the liquid oxygen product may be withdrawn and evaporated by passage through the main heat exchanger 6. Alternatively a gaseous oxygen product may be withdrawn from the lower pressure rectification column 18 and warmed by passage through the main heat exchanger 6.

If desired, the expansion turbines 76 and 78 may be operated with inlet pressures higher than the outlet pressure of the compressor 22 depending on the amounts of liquid products required and on the pressure of the impure gaseous oxygen product withdrawn from the intermediate pressure rectification column 16. A further booster-compressor (not shown) may accordingly be used to compress a slip stream withdrawn from downstream of the compressor 22 but upstream of the warm end 8 of the main heat exchanger 6.

Figure 2:
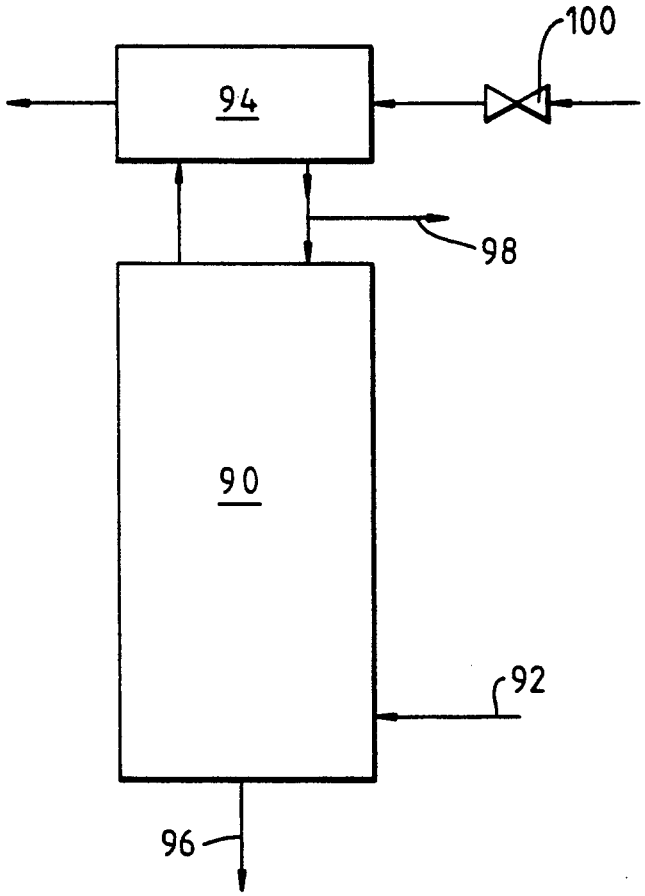
FIG. 2 is a schematic flow diagram illustrating a modification to the plant shown in FIG. 1 that enables argon to be produced.

It is also possible to produce an argon product. Plant for so doing is illustrated in FIG. 2 of the accompanying drawings. The plant includes a further rectification column 90 which contains liquid-vapour contact trays (not shown) or other means (not shown) for effecting intimate contact and hence mass transfer within the column 90 between an ascending vapour phase and a descending liquid phase. The further rectification column 90 has an inlet 92 for a stream of a gaseous oxygen-argon mixture withdrawn from the lower pressure rectification column 18 (not shown in FIG. 2) at a region where the argon concentration is at or near to its maximum. The oxygen-argon mixture is separated in the column 90, the vapour phase becoming progressively richer in argon as it ascends. The further rectification column 90 is provided at its top with a condenser 94. The condenser 94 has passages communicating with a gas space at the top of the column 90. In operation, an argon vapour typically containing less than 3% by volume of oxygen, passes from the top of the column 90 and is condensed in the condenser 94. A part of the resulting condensate flows back into the column 90 as liquid reflux. Liquid oxygen is withdrawn through an outlet 96 from the bottom of the column 90 and is returned to the lower pressure rectification column 18.

The remainder of the condensate is withdrawn through an outlet 98 as a liquid argon product. If desired, this product may be purified by conventional means (not shown in FIG. 2).

When a further rectification column 90 is employed to product an argon product, the feed stream to the lower pressure rectification column 18 is typically taken from intermediate the heat exchanger 30 and the throttling valve 32. A part of this feed stream is however diverted and passed through a throttling valve 100 upstream of the condenser 94. Downstream of the throttling valve 100, this part of the feed stream flows through the condenser 94 in indirect heat exchange relationship with argon being condensed. The stream is thus at least partially reboiled and the resulting fluid is introduced into the lower pressure rectification column 18 for separation therein.

Set out in the Table below is a typical example of operation of the plant shown in and described with reference to FIG. 1 provided with a further rectification column for production of argon as shown in and described with reference to FIG. 2.

| Description of Stream | Flow $Nm^3/h$ | Temp K | Pressure bar (absolute) | Composition % $O_2$ |
|---|---|---|---|---|
| Total air at the exit of the purification unit 4 | 286700 | 298 | 18.7 | 20.956 |
| High pressure air exiting the compressor 22 | 167200 | 298 | 75.0 | 20.956 |
| Air at the inlet to the turbine 76 | 30300 | 256 | 74.95 | 20.956 |
| Air at the inlet to the turbine 78 | 42100 | 180 | 74.9 | 20.956 |
| Air at the inlet 12 to the HP column 14 | 191900 | 122 | 18.4 | 20.956 |
| Air at the entrance to the throttling valve 24 | 94800 | 122 | 74.85 | 20.956 |
| $N_2$ (second product) at outlet 74 of the LP column 18 | 33900 | 81.5 | 1.5 | 0.5 |
| $N_2$ (second product) ex plant | 33900 | 295 | 1.2 | 0.5 |
| $N_2$ at outlet 46 of the IP column 16 | 245100 | 98.9 | 7.0 | 0.5 |
| Intermediate pressure $N_2$ product ex plant | 180100 | 295 | 6.8 | 0.5 |
| Recycle nitrogen at inlet to the compressor 50 | 65000 | 298 | 12.2 | 0.5 |
| Liquid oxygen product (under storage conditions) | 2100 | 92.0 | 1.8 | 99.6 |
| Liquid nitrogen product (under storage conditions) | 7200 | 83.5 | 6.8 | 0.0001 |
| Liquid oxygen at inlet 72 to IP column 16 | 6000 | 97.3 | 7.2 | 99.6 |
| First oxygen product ex plant | 63200 | 295 | 43.0 | 90.0 |
| Liquid argon product (under storage conditions) | 200 | 91.0 | 1.4 | 1.8 |

In this example no nitrogen product is withdrawn from the higher pressure rectification column 14.

I claim:

1. A method of separating air, comprising: rectifying air in a rectification system comprising a higher pressure rectification column, a lower pressure rectification column and an intermediate pressure rectification column; providing each column with liquid nitrogen reflux; employing vapour from the higher pressure rectification column to reboil liquid obtained in the intermediate pressure rectification column and vapour from the intermediate pressure rectification column to reboil liquid obtained in the lower pressure rectification column; introducing a stream of feed air into the higher pressure rectification column; withdrawing a first oxygen product and a first gaseous nitrogen product from the intermediate pressure rectification column; and also withdrawing a second nitrogen product or stream from the lower pressure rectification column.

2. The method as claimed in claim 1, in which:

the first nitrogen product is withdrawn from an intermediate separation stage of the intermediate pressure rectification column; and a third nitrogen product of greater purity than the first nitrogen product is withdrawn from a separation stage of the intermediate pressure rectification column located above such stage.

3. The method as claimed in claim 1, in which:

the higher pressure rectification column is operated at its top at a pressure in the range of about 12 to 20 bar;

the intermediate pressure rectification column at its top at a pressure in the range of about 4 to 8 bar; and the lower pressure rectification column at its top at a pressure in the range of about 1 to 2 bar.

4. The method as claimed in claim 1, in which the first oxygen product contains from about 80 to 95% by volume of oxygen.

5. The method as claimed in claim 1, in which a second oxygen product is withdrawn from the lower pressure rectification column.

6. The method as claimed in claim 1, in which no second oxygen product is withdrawn, but a stream of liquid oxygen is taken form the lower pressure rectification column and is introduced into one of the other rectification columns.

7. The method as claimed in claim 1, in which:

a first feed air stream is cooled by countercurrent heat exchange with the first oxygen and first nitrogen products in a main heat exchanger to a temperature suitable for its rectification;

the first oxygen product is withdrawn in liquid state and is vaporised by its passage through the main heat exchanger; and a second feed air stream is passed through the main heat exchanger co-currently with and at a higher pressure than the first feed air stream.

8. The method as claimed in claim 7, in which the second feed air stream is used as a source of air for expansion with the performance of external work so as to meet the refrigeration requirements of the method.

9. A method as claimed in claim 1, in which:

vapour employed to reboil the liquid obtained in the intermediate pressure rectification column is thereby condensed to form liquid nitrogen, and one part of the liquid nitrogen is used as reflux in the higher pressure rectification column, another part of the liquid nitrogen is used as reflux in the lower pressure rectification column, and a further part of the liquid nitrogen is used as reflux in the intermediate pressure rectification column.

10. The method as claimed in claim 9, in which the said further part of the liquid nitrogen condensate is introduced into an intermediate separation stage of the intermediate pressure rectification column, and the first nitrogen product is withdrawn from said stage.

11. The method as claimed in claim 10, in which the liquid nitrogen flow to the stage of the intermediate pressure rectification column from which the first nitrogen product is taken is supplemented by taking a part of the first nitrogen product, recompressing it, condensing it and returning it to said stage of said intermediate pressure rectification column.

12. The method as claimed in claim 1, in which a stream of oxygen-enriched liquid air is withdrawn from the bottom of the higher pressure rectification column, is sub-cooled, and is passed through a throttling valve into the intermediate pressure rectification column.

13. The method as claimed in claim 1, in which the lower pressure rectification column is fed with at least one of the following streams:

a stream of oxygen-enriched liquid air from the higher pressure rectification column;

a stream of corresponding composition from the intermediate pressure rectification column; and a stream of liquid air taken from the high pressure rectification column, and a stream withdrawn from the first oxygen product.

14. An apparatus for separating air comprising:

a higher pressure rectification column, a lower pressure rectification column; and an intermediate pressure rectification column;

means for providing each rectification column with liquid nitrogen reflux;

a first reboiler for reboiling, by heat exchange with vapour from the higher pressure rectification column, liquid obtained in the intermediate pressure rectification column;

a second reboiler for reboiling, by heat exchange with vapour from the intermediate pressure rectification column, liquid obtained in the lower pressure rectification column;

an inlet to the higher pressure rectification column for a feed air stream;

an outlet from the intermediate pressure rectification column for the withdrawal of a first oxygen product;

an outlet from the intermediate pressure rectification column for the withdrawal of a first gaseous nitrogen product; and an outlet from the lower pressure rectification column for the withdrawal of a second nitrogen product or stream.

15. The apparatus as claimed in claim 14, in which there is a further outlet for a second oxygen product from the lower pressure rectification column, and a further outlet for a third nitrogen product, of higher purity than the first nitrogen product, from a separation stage of the intermediate pressure rectification column above that from which the first nitrogen product is taken.

16. The apparatus as claimed in claim 14, additionally including:

a main heat exchanger having passages therethrough form a warm end to a cold end for first and second feed air streams in heat exchange relationship with passages therethrough for a first oxygen product stream and a first nitrogen product stream;

a pump for withdrawing the stream of the first oxygen product in liquid state and feeding it to the passage in the main heat exchanger for such stream; and a booster compressor for raising the pressure of the second feed air stream to above that of the first feed air stream.

17. The apparatus as claimed in claim 16, additionally including first and second expansion turbines for generating refrigeration in communication with the passage through the main heat exchanger for the second feed air stream.

18. The apparatus as claimed in claim 14, in which the first reboiler is adapted to condense said vapour passing into it so as to form liquid nitrogen condensate, and there is means for introducing such liquid nitrogen condensate as reflux into each of the rectification columns.

19. The apparatus as claimed in claim 18,, in which the means for introducing liquid nitrogen condensate into said intermediate pressure rectification column communicates with a separation stage of such column with which said outlet for the first nitrogen product communicates.

20. The apparatus as claimed in claim 19, additionally including:

a compressor for recompressing a part of the first nitrogen product; and a condenser for condensing the recompressed nitrogen, said condenser having an outlet for condensed nitrogen communicating with said separation stage of the intermediate pressure column.

21. The apparatus as claimed in claim 20, in which the second reboiler has passages adapted to condense said vapour passing into it so as to form liquid nitrogen condensate, said passages communicating with a separation stage of the intermediate pressure rectification column above that with which the outlet for the first nitrogen product communicates.

22. The apparatus as claimed in claim 14, in which there is means for passing oxygen-enriched liquid air from the higher pressure rectification column to the intermediate pressure rectification column.

23. The apparatus as claimed in claim 14, in which there is means for passing one or more of the following streams to the lower pressure rectification column:

a stream of oxygen-enriched liquid air from the higher pressure rectification column;

a stream of corresponding composition from the intermediate pressure rectification column;

a stream of liquid air from the higher pressure rectification column; and a stream withdrawn from the first oxygen product.

* * * * *